US005159795A

United States Patent [19]

Colen

[11] Patent Number: 5,159,795

[45] Date of Patent: Nov. 3, 1992

[54] WALL CONSTRUCTION AND SPACER FOR USE THEREWITH

[76] Inventor: William J. Colen, 11248 Jamestown, Dallas, Tex. 75230

[21] Appl. No.: 775,285

[22] Filed: Oct. 11, 1991

Related U.S. Application Data

[63] Continuation-in-part of Ser. No. 553,176, Jul. 13, 1990, Pat. No. 5,056,289.

[51] Int. Cl.[5] ..... E04B 1/02

[52] U.S. Cl. ..... 52/564; 52/712; 52/428

[58] Field of Search ..... 52/562, 564, 285, 605, 52/379, 383, 509, 387, 486, 488, 435, 437, 712, 713, 428

[56] References Cited

U.S. PATENT DOCUMENTS

| | | | |
|---|---|---|---|
| 581,940 | 5/1897 | Pelton | 52/509 |
| 783,470 | 2/1905 | Schreck | 52/714 |
| 840,111 | 1/1907 | Collins | 182/228 |
| 901,833 | 10/1908 | Rettig | 52/421 |
| 949,527 | 2/1910 | Ensminger et al. | 52/421 |
| 963,776 | 7/1910 | Kosack | 52/715 |
| 965,778 | 7/1910 | Kosack | 52/713 |
| 1,052,670 | 2/1913 | Francis | 52/714 |
| 1,451,144 | 4/1923 | Decker | 52/437 |
| 1,503,931 | 8/1924 | Wightman | 52/421 |
| 1,558,247 | 10/1925 | Decker | 52/435 |
| 1,610,398 | 12/1926 | Tinker | 52/124.2 |
| 1,968,393 | 7/1934 | Henderson | 52/41 |
| 1,982,560 | 11/1934 | Williams | 52/387 |
| 1,997,092 | 4/1935 | Duffy | 52/488 |
| 2,043,706 | 9/1936 | Myers | 52/387 |
| 3,696,576 | 10/1972 | de Barros | 52/747 |
| 4,062,159 | 12/1977 | Pahr | 52/421 |
| 4,696,140 | 9/1987 | Marshall | 52/482 |
| 5,056,289 | 10/1991 | Colen | 52/564 |

FOREIGN PATENT DOCUMENTS

| | | | |
|---|---|---|---|
| 320589 | 4/1920 | Fed. Rep. of Germany | 52/714 |

*Primary Examiner*—James L. Ridgill, Jr.
*Attorney, Agent, or Firm*—David H. Judson

[57] ABSTRACT

The present invention describes a unique wall construction and spacer for use by unskilled labor in such construction. Preferably, the wall comprises a plurality of blocks arranged in layers one above the other, each of the blocks having an exterior face, an interior face, a top and a bottom, the top and bottom of each block having a wedge-shaped longitudinal groove therein aligned with the grooves of adjacent blocks. The spacer comprises a base supported against the interior faces of adjacent blocks, and first and second arms extending transversely from the base and supported against the tops of said adjacent blocks. Each arm includes at its distal or medial end upper and lower wedge-shaped tabs, the lower tab for extending downwardly into the groove or opening of a block underlying the arm and the upper tab for extending upwardly into the groove or opening of the block overlying the arm.

7 Claims, 4 Drawing Sheets

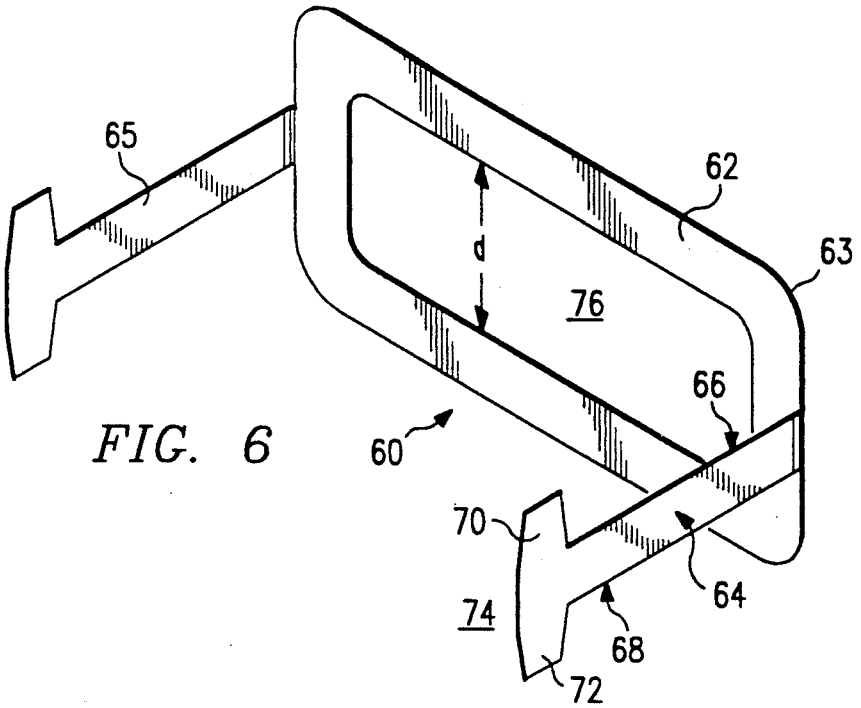
FIG. 6
FIG. 6A
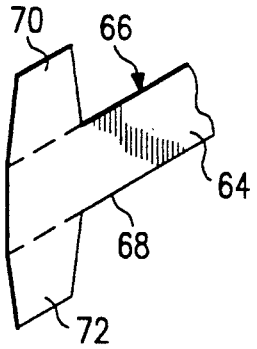
FIG. 6B
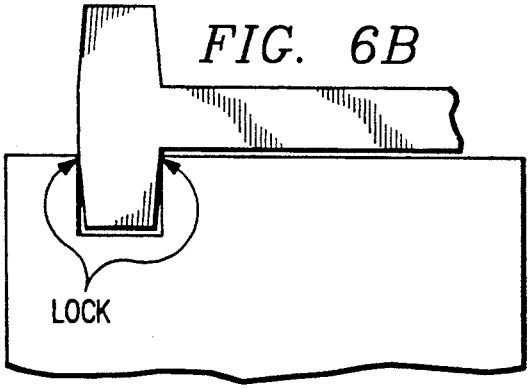
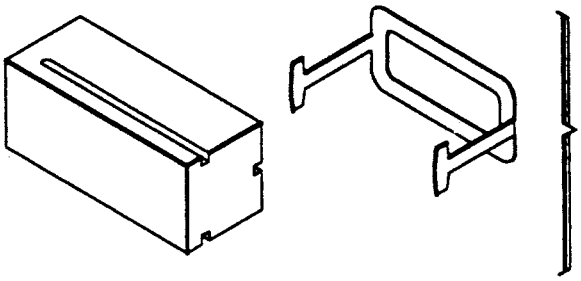
FIG. 7

WALL CONSTRUCTION AND SPACER FOR USE THEREWITH

This application is a continuation-in-part of prior copending application Ser. No. 07/553,176, filed Jul. 13, 1990, now U.S. Pat. No. 5,056,289 issued Oct. 15, 1991.

TECHNICAL FIELD

The present invention relates generally to construction of brick walls and more particularly to a novel spacer for use in such construction to facilitate correct alignment of the bricks even by unskilled laborers.

BACKGROUND OF THE INVENTION

Masonry construction techniques are well-known in the art. Such techniques, however, are impractical for many building projects due to the high cost of labor and materials. Additionally, because mortar must be applied by hand to each brick and the brick must be properly aligned with the bricks already in place, a high degree of skill is required to provide an aesthetically-pleasing result. Such results are extremely difficult to achieve with unskilled labor.

There have been attempts in the prior art to provide systems for assisting a laborer to properly aligning the bricks of a wall construction. Such systems are described in U.S. Pat. Nos. 2,172,816 and 3,170,267 to Douglas et al and Rosenfeld, respectively. In Douglas et al, for example, a plurality of T-shaped dowel plates are supported in aligned grooves along at least three edges of each brick. Rosenfeld describes a system wherein rod-like members are provided for vertical alignment with cross bars between such members for horizontal alignment.

While such systems do provide improvements over manual techniques for aligning bricks in a wall construction, they do not adequately solve the problems associated with the use of unskilled labor. Moreover, the complexity of such systems make them difficult to use in practice and often more expensive than the cost of labor and materials. Such systems also do not reliably stabilize the bricks against lateral movement.

There is therefore a need to provide an improved wall construction technique that overcomes these and other problems associated with the prior art.

BRIEF SUMMARY OF THE INVENTION

It is an object of the present invention to provide a method for constructing a brick wall using unskilled labor.

It is yet another object of the present invention to describe a method for constructing a brick wall that utilizes a plurality of inexpensive yet reliable alignment spacers.

It is a further object of the invention to provide a novel spacer construction for use by unskilled laborers in the construction of a brick wall.

It is yet a further object of the present invention to describe a brick wall construction comprising a plurality of bricks arranged in layers one above the other, and a plurality of simple-to-use spacers to aid in the construction of the wall.

It is a another object of the invention to provide a brick wall construction technique that is simple to implement and results in significant labor cost savings over prior art techniques.

These and other objects of the invention are provided in a wall construction for a building or the like. The wall comprises a plurality of blocks, e.g., bricks, arranged in layers one above the other, each of the blocks having an exterior face, an interior face, a top and a bottom. The top and bottom of each block preferably has a wedge-shaped longitudinal groove therein aligned with the grooves of adjacent blocks. According to the invention, a plurality of spacers are also provided and arranged between adjacent blocks to assist the laborer in aligning the blocks in horizontal, vertical and lateral planes to insure that the constructed wall presents an aesthetically-pleasing appearance. In the preferred embodiment, each spacer has a base adapted for support against the interior faces of adjacent blocks, and first and second arms extending transversely from the base and adapted for support against the tops of the adjacent blocks. Each arm includes at its distal end upper and lower wedge-shaped tabs, the lower tab extending downwardly into the wedge-shaped groove of a block underlying the arm and the upper tab extending upwardly into the groove of the block overlying the arm.

The foregoing has outlined some of the more pertinent objects of the present invention These objects should be construed to be merely illustrative of some of the more prominent features and applications of the invention. Many other beneficial results can be attained by applying the disclosed invention in a different manner of modifying the invention as will be described. Accordingly, other objects and a fuller understanding of the invention may be had by referring to the following Detailed Description of the preferred embodiment.

BRIEF DESCRIPTION OF THE DRAWINGS

For a more complete understanding of the present invention and the advantages thereof, reference should be made to the following Detailed Description taken in connection with the accompanying drawings in which:

FIG. 6 is a perspective view of another type of spacer construction for use in the present invention;

FIG. 6A is a detailed view of the tab structures of the spacer of FIG. 6A;

FIG. 6B is a detailed cross-sectional view of the positioning of the wedge-shaped tab in a square alignment groove;

FIG. 7 is a perspective view of block having longitudinal grooves for use in a wall construction in conjunction with the spacer of FIG. 6;

DETAILED DESCRIPTION

Figure 1:
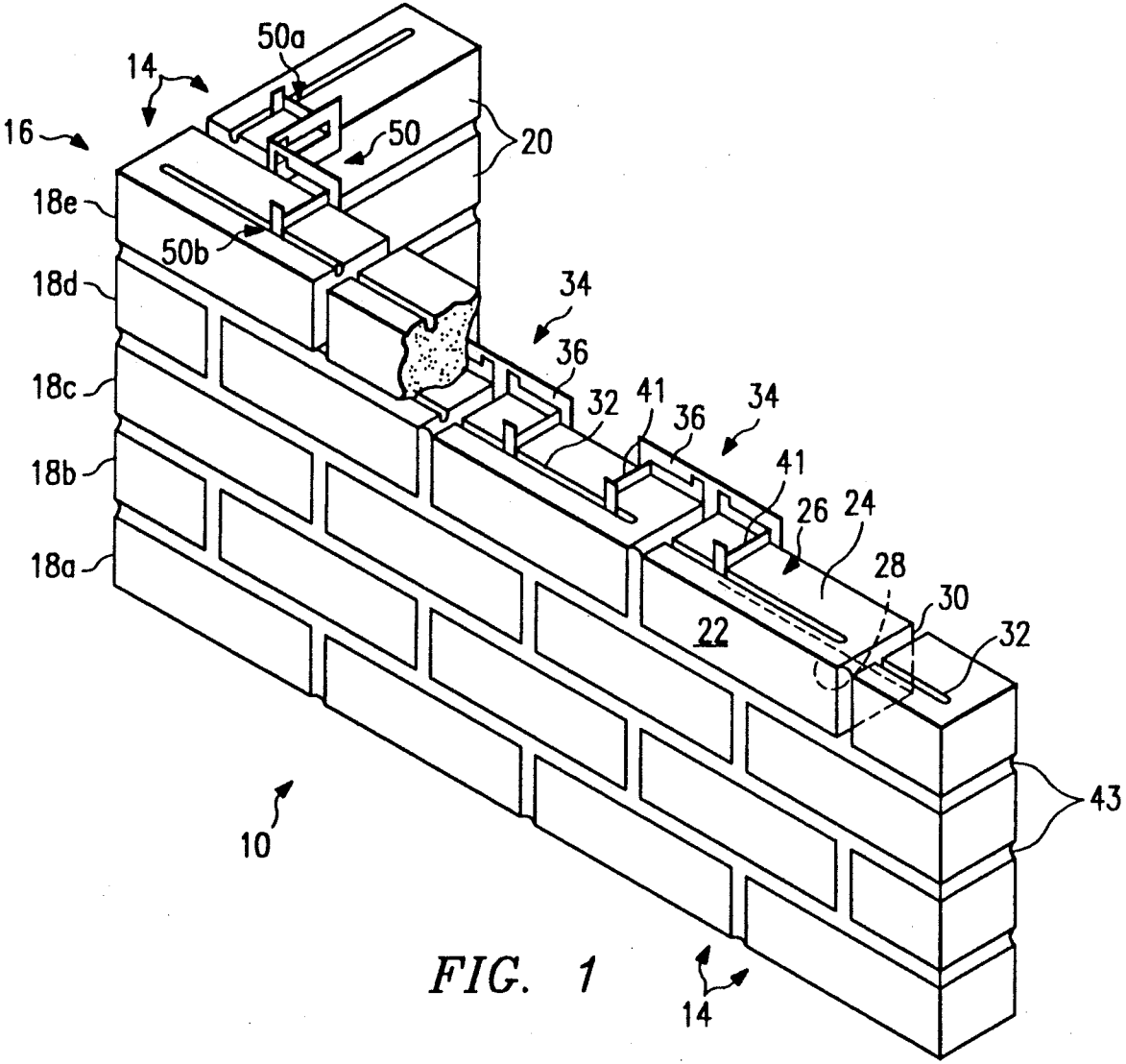
FIG. 1 is a perspective view of a brick wall construction according to the present invention wherein a plurality of spacers are used to facilitate alignment of the bricks by laborers.

Referring now to FIG. 1, a novel wall construction 10 is shown and includes a front portion 12 and a side portion 14 defining a corner 16. The wall comprises a plurality of blocks 20 arranged in layers 18*a*–18*e* one above the other, each of the blocks having an exterior face 22, an interior face 24, a top 26, a bottom 28 and sides 30. Each of the blocks is preferably a brick, although it should be appreciated that the teachings of this invention are applicable to any wall construction using blocks and not merely brick walls. The top 26 and bottom 28 of each block 20 preferably includes an alignment means such as a longitudinally-extending groove or notch 32. As seen in FIG. 1, the grooves 32 are aligned with the grooves of adjacent blocks. While the use of longitudinal grooves is preferred, it should also be appreciated that each brick can alternatively incorporate other types of alignment means. For example, conventional clay bricks typically are manufactured with one or more transverse holes throughout the mid-section of each brick. Such holes are useful as the alignment means as will be described in more detail below.

Figure 2:
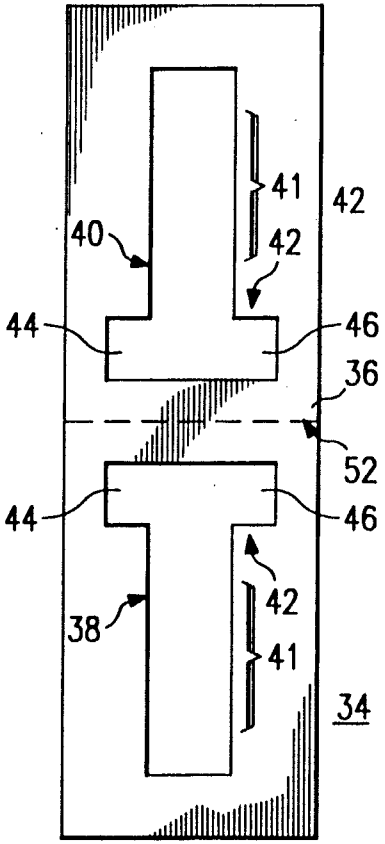
FIG. 2 is a top view of one of the spacers of FIG. 1 showing the flattened construction thereof prior to separation of the support arms from the base thereof.
Figure 3:
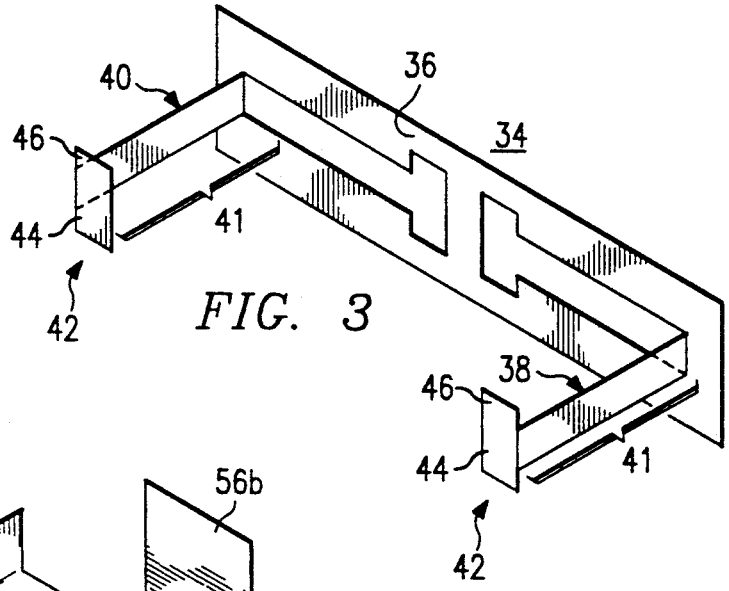
FIG. 3 is a perspective view of the spacer of FIG. 2 with the support arms extended away from the base.

According to the invention, a plurality of spacers 34 are arranged between adjacent blocks for the purpose of facilitating the proper alignment of the blocks during construction of the wall. Referring simultaneously to FIGURES 2 and 3, each of the spacers is preferably formed in a flat profile and includes a base 36 having first and second support arms 38 and 40 integrally-formed therein. The support arms 38 and 40 are adapted to be cut-out from the remainder of the base 36 in the manner shown in FIG. 3 to enable the spacer to be used in the wall construction. Each support arm preferably includes at its distal end a tab 42 having first and second portions 44 and 46.

In operation, each of the support arms 38 and 40 is extended substantially transversely from the base and the tab 42 is then itself turned substantially transversely with respect to the arm such that the tab is substantially parallel to the base. This structure can be effected by the manufacturer or, alternatively, by the laborer at the jobsite. The resulting spacer construction is best seen in FIG. 3. Alternatively, the spacer can be formed with or without cut-out portions using arms secured to the base by welding, hinges, fasteners or the like. The major portion 41 of each arm has a predetermined height equal to the desired height (approximately ⅜ of an inch) of the mortar joint 43 between successive layers 18 of the brick wall.

Referring now back to FIG. 1, the major portions 41 of the first and second arms are supported against the tops 26 of adjacent blocks, and the base 36 is advantageously supported against the interior faces 24 of the adjacent blocks. This spacer structure and placement provides horizontal, vertical and lateral stabilization of each brick as the brick is placed in its proper position on the wall. In particular, the first portion 44 extends downwardly into the groove of a block underlying the arm and the second portion 46 extends upwardly into the groove of the block overlying the arm.

The spacer of FIG. 3 is preferably formed of steel, aluminum or other metals. Suitable other materials include impact resistant cardboard, composites or rigid plastics. The spacer has significant advantages over the prior art. It is simple and inexpensive to manufacture and provides a reliable tool for assisting even unskilled laborers to construct a brick wall. The spacer is designed to remain in the wall upon use. Each spacer is formed in a flat profile and the spacers can be easily transported to the jobsite and stored for subsequent use. Moreover, the use of the cut-out support arms as described above is especially advantageous because the voids left by the cut-outs facilitate the removal of excess mortar in the mortar joint 43 when the overlying brick is placed on the spacer. Without these voids, excess mortar would be forced forwards toward the exterior face and would be difficult to remove properly without extensive effort by the laborer.

As also seen in FIG. 1, a corner spacer 50 is provided by manufacturing the spacer with a transverse line of weakness 52 as shown in FIG. 2 in phantom. This line of weakness enables the spacer to be bent into first and second transverse sections 50*a* and 50*b*.

Although not shown in detail in FIGS. 2 and 3, it should be appreciated that the structure of the tab 42 can be suitably changed to cooperate with the various types of alignment means in the top and bottom of each brick. As discussed above, for example, if clay bricks are used for the blocks, each tab has a semi-circular structure to mate with the transverse holes extending through the brick. Of course, the exact placement of the longitudinal groove or other alignment means in each brick is not critical although preferably such grooves are located adjacent the exterior face of the brick such that the weight of the overlying brick is distributed along a relatively long support arm.

Figure 4:
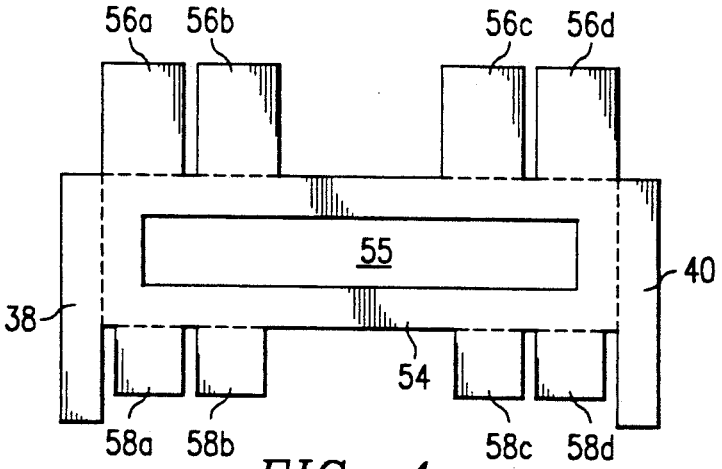
FIG. 4 is a top view of an alternate embodiment of the spacer in its flattened form.
Figure 5:
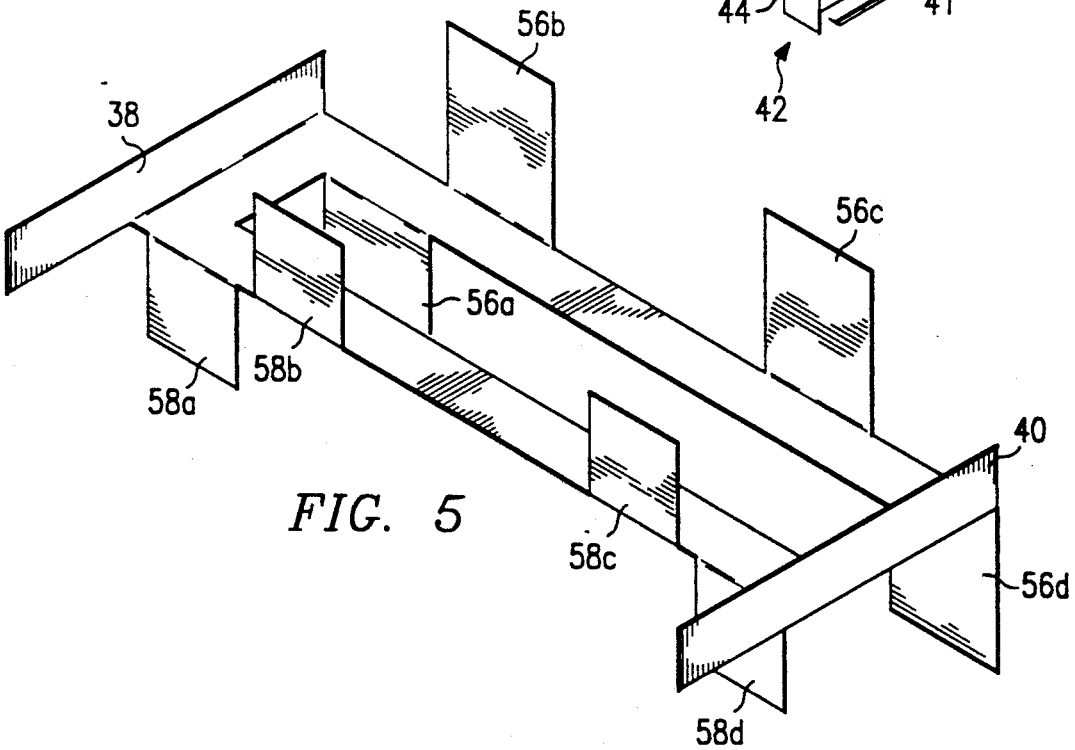
FIG. 5 is a perspective view of the spacer of FIG. 4 adapted for use in the wall construction.

FIGS. 4 and 5 show an alternate embodiment of the spacer according to the present invention. Spacer 52 comprises a base 54 having a cut-out portion 55. A plurality of tabs 56*a*–56*d* extend from one side of the spacer and a plurality of tabs 58*a*–58*d* extend from the opposite side. First and second support arms 38 and 40 extend from the sides of the spacer. Upon folding of the tabs 56 and 58 as shown in FIG. 5, the spacer is useful in aligning bricks as described above. In particular, tabs 56 are supported against the interior faces 24 of adjacent bricks and correspond to the base of the spacer described above in FIG. 2. Tabs 58 are then supported in the longitudinal grooves of the bricks.

Referring now to FIGS. 6 and 6A, an alternate spacer construction is shown for use in the construction of a wall comprising a plurality of blocks arranged in at least first and second layers spaced one above the other by a predetermined distance. As previously described with respect to FIG. 1, each of the blocks has an exterior face, an interior face, a top and a bottom, with the top and bottom of each block having alignment means located a predetermined distance from the interior face and adapted to be aligned with the alignment means of adjacent blocks, with the tops of adjacent blocks in each layer located in a common plane (see reference numeral 100 in FIG. 9). Preferably the spacer 60 is used with blocks having a squareshaped or wedge-shaped alignment means. A block with a square-shaped alignment groove is shown, for example, in FIG. 7. The spacer 60 includes a base 62 for support against the interior faces of adjacent blocks. The base preferably includes rounded corners 63 for ease and safety of handling by the user. A first support arm 64 extends transversely from the base 62 in a plane (see reference numeral 102 in FIG. 9) perpendicular to the common plane, the arm 64 having an upper edge 66 for supporting a bottom of a block in the second layer and a lower edge 68 for supporting a top of the block in the first layer. In this way, a mortar joint is created between the first and second layers of the wall.

The spacer 60 further includes upper and lower wedge-shaped tabs 70 and 72 located at a distal end 74 of the support arm 64 for being received in the longitudinal grooves of the blocks overlying and underlying the support arm. As best seen in FIG. 6A, the tabs 70 and 72 are located in the same plane as the plane of the support arm. When the alignment groove is square, the tabs "lock" therein when the spacer is positively positioned, as best seen in FIG. 6B. Of course, the tabs 70 and 72 can be made to fit precisely into the groove, whether the groove is square, wedge-shaped or any other shape.

Referring back to FIG. 6, the base 62 includes the cut-out portion 76 which, when the spacer is placed, is located adjacent to the mortar joint such that excess mortar can be removed through the cut-out portion 76 during the wall construction. The cut-out portion preferably has an cross-sectional dimension "d" greater than the predetermined distance between the first and second layers of the wall. This larger area of the cut-out portion facilitates the prompt and efficient removal of excess mortar.

Figure 8:
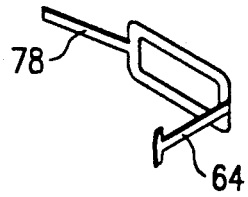
FIG. 8 is a perspective view of another type of spacer for use in the corner of a wall construction.
Figure 9:
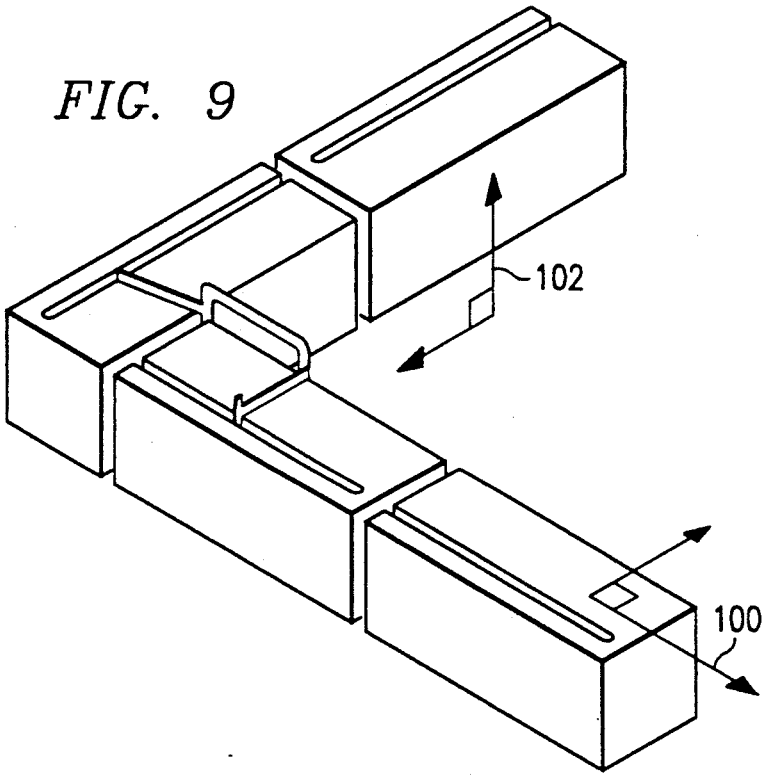
FIG. 9 is a perspective view showing how the spacer of FIG. 8 is used to facilitate the corner wall construction.

Referring now to FIG. 8, the spacer may alternatively include a second support arm 78 extending from the base 62 at an oblique angle to enable the spacer to be used in a corner of the wall. The oblique angle is approximately 135 degrees. The placement of the spacer is shown in FIG. 9, which is a perspective view of a corner wall construction. Of course, it should be appreciated that the spacer of FIG. 8 can be formed from the spacer of FIG. 6 at the jobsite by merely cutting the distal end of the second support arm (i.e., the portion of the second support arm having the upper and lower tabs) and then bending the second support arm to the desired oblique angle.

Figure 10:
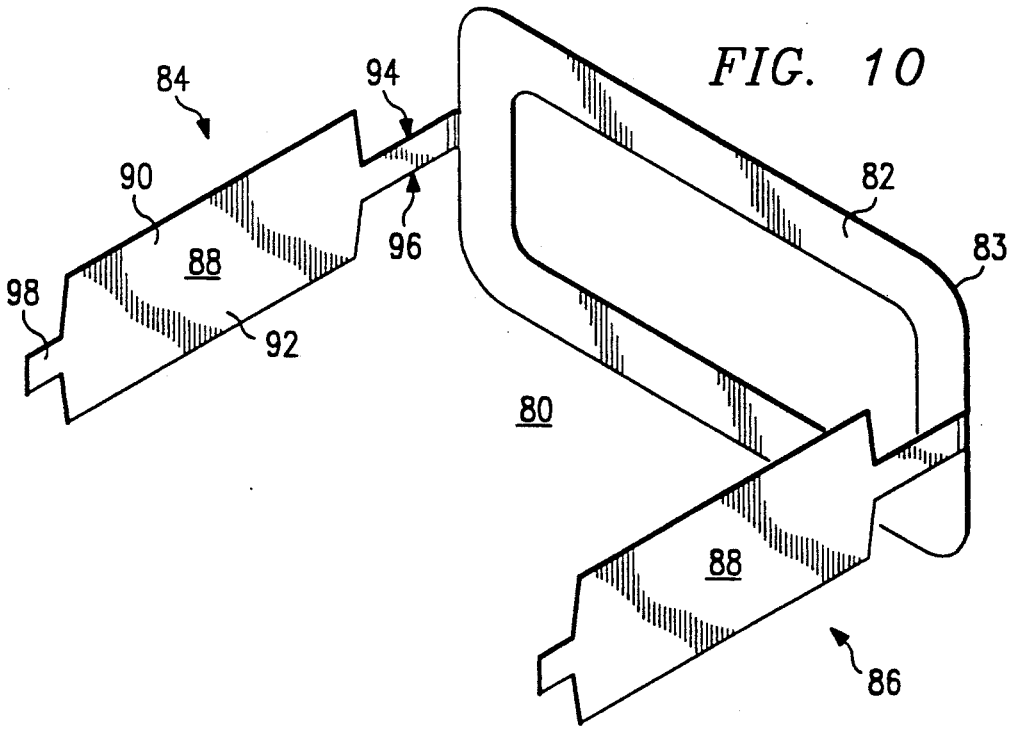
FIG. 10 is a perspective view of yet another type of spacer for use in a wall construction comprising blocks; and Similar reference characters refer to similar parts throughout the several views of the drawings.

FIG. 10 shows yet another alternate embodiment of the spacer 80 for use in the construction of a wall comprising a plurality of blocks arranged in at least first and second layers spaced one above the other by a predetermined distance. As previously described with respect to FIG. 1, each of the blocks has an exterior face, an interior face, a top and a bottom, with the top and bottom of each block having alignment means located a predetermined distance from the interior face and adapted to be aligned with the alignment means of adjacent blocks, with the tops of adjacent blocks in each layer located in a common plane. Preferably the spacer 80 is used with blocks having alignment means in the form of one or more relatively large openings. These openings are preferably circular but can be of any appropriate shape.

In the embodiment of FIG. 10, the spacer comprises a base 82 for support against the interior faces of adjacent blocks. The base preferably includes rounded corners 83 for ease and safety of handling by the user. A first support arm 84 extends transversely from the base 82 in a plane Perpendicular to the common plane. The spacer 80 also may include a second support arm 86 that extends transversely from the base 82. One or both of the support arms include an medial portion 88. Each medial portion 88 includes upper and lower wedge-shaped tabs 90 and 92 for being received in the alignment openings of the blocks overlying and underlying the support arm. Each of the support arms has an edge 94 for supporting a bottom of a block in the second layer and a edge 96 for supporting a top of the block in the first layer. In this way, a mortar joint is created between the first and second layers of the wall. The spacer 80 may also include a tab 98 at the distal end of each support arm.

It should be appreciated by those skilled in the art that the specific embodiments disclosed above may be readily utilized as a basis for modifying or designing other structures for carrying out the same purposes of the present invention. For example, a second set of longitudinal grooves can be formed in the top and bottom of each brick for receiving the base portion of each spacer. Such grooves would be parallel to the grooves 32 shown in FIG. 1 and would be located adjacent to the interior face 24. In this embodiment, the height of the base is decreased and is made substantially equal to the height of the tab 42. It should also be realized by those skilled in the art that such equivalent constructions do not depart from the spirit and scope of the invention as set forth in the appended claims.

What is claimed is:

1. A wall, comprising:

a plurality of blocks arranged in at least first and second layers spaced one above the other by a predetermined distance, each of the blocks having an exterior face, an interior face, a top and a bottom, the top and bottom of each block having a longitudinal groove located a predetermined distance from the interior face and adapted to be aligned with the grooves of adjacent blocks, wherein the tops of adjacent blocks in each layer are located in a common plane;

a plurality of spacers each having a base supported against the interior faces of adjacent blocks in the first layer, each spacer having at least one arm extending transversely from the base in a plane perpendicular to the common plane, the arm having an upper edge supported against the bottom of a block in the second layer and a lower edge supported against the top of a block in the first layer, the arm including at its distal end upper and lower wedge-shaped tabs, the lower wedge-shaped tab extending downwardly into the longitudinal groove of a block in the first layer and the upper wedge-shaped tab extending upwardly into the longitudinal groove of a block in the second layer; and a cementitious material located in the space between the first and second layers.

2. A spacer for use in the construction of a wall comprising a plurality of blocks arranged in at least first and second layers spaced one above the other by a predetermined distance, each of the blocks having an exterior face, an interior face, a top and a bottom, the top and bottom of each block having an opening adapted to be aligned with like openings of adjacent blocks, wherein the tops of adjacent blocks in each layer are located in a common plane, comprising:

a base for support against the interior faces of adjacent blocks;

at least one support arm extending transversely from the base in a plane perpendicular to the common plane, the arm having an upper edge for supporting a bottom of a block in the second layer and a lower edge for supporting a top of the block in the first layer such that a mortar joint is created between the first and second layers; and upper and lower wedge-shaped tabs located along a medial portion of the support arm for being received in the opening of a block;

wherein the base includes a cut-out portion located adjacent to the mortar joint such that excess mortar can be removed through the cut-out portion during the wall construction.

3. A spacer for use in the construction of a wall comprising a plurality of blocks arranged in at least first and second layers spaced one above the other by a predetermined distance, each of the blocks having an exterior face, an interior face, a top and a bottom, the top and bottom of each block having alignment means located a predetermined distance from the interior face and adapted to be aligned with the alignment means of adjacent blocks, wherein the tops of adjacent blocks in each layer are located in a common plane, comprising:

a base for support against the interior faces of adjacent blocks;

at least one support arm extending transversely from the base in a plane perpendicular to the common plane, the arm having an upper edge for supporting a bottom of a block in the second layer and a lower edge for supporting a top of the block in the first layer such that a mortar joint is created between the first and second layers; and upper and lower wedge-shaped tabs located at a distal end of the support arm for being received in the alignment means of a block;

wherein the base includes a cut-out portion located adjacent to the mortar joint such that excess mortar can be removed through the cut-out portion during the wall construction.

4. The spacer as described in claim 3 wherein the base has rounded corners.

5. The spacer as described in claim 3 wherein the cut-out portion has a cross-sectional dimension greater than the predetermined distance.

6. The spacer as described in claim 3 further including a second support arm extending from the base at an oblique angle to enable the spacer to be used in a corner of the wall.

7. The spacer as described in claim 6 wherein the oblique angle is approximately 135 degrees.

* * * * *